United States Patent [19]

Peterson

[11] 4,043,243

[45] * Aug. 23, 1977

[54] ELECTRONIC CHORUS AND TREMULANT SYSTEM

[76] Inventor: Richard H. Peterson, 11748 Walnut Ridge Drive, Palos Park, Ill. 60464

[ * ] Notice: The portion of the term of this patent subsequent to Feb. 18, 1992, has been disclaimed.

[21] Appl. No.: 543,095

[22] Filed: Jan. 22, 1975

Related U.S. Application Data

[63] Continuation-in-part of Ser. No. 406,411, Oct. 15, 1973, Pat. No. 3,886,835, which is a continuation of Ser. No. 44,276, June 8, 1970, abandoned.

[51] Int. Cl.[2] ..... G10H 1/04

[52] U.S. Cl. ..... 84/1.25; 84/1.24; 84/DIG. 4

[58] Field of Search ..... 84/DIG. 4, 1.24, 1.25, 84/1.01; 332/22

[56] References Cited

U.S. PATENT DOCUMENTS

| | | | |
|---|---|---|---|
| 2,835,814 | 5/1958 | Dorf | 84/1.25 X |
| 2,869,669 | 1/1959 | Leslie | 84/DIG. 4 X |
| 3,004,460 | 10/1961 | Wayne | 84/1.01 |
| 3,069,958 | 12/1962 | Arsem et al. | 84/1.25 |
| 3,083,606 | 4/1963 | Bonham | 84/1.25 |
| 3,146,292 | 8/1964 | Bonham | 84/1.25 |
| 3,160,695 | 12/1964 | Bonham | 84/DIG. 4 X |
| 3,215,767 | 11/1965 | Martin | 84/1.24 |
| 3,229,019 | 1/1966 | Peterson | 84/1.24 X |
| 3,336,432 | 8/1967 | Hurvitz | 84/1.24 X |
| 3,886,835 | 6/1975 | Peterson | 84/DIG. 4 X |

*Primary Examiner*—Ulysses Weldon

*Attorney, Agent, or Firm*—Jones, Tullar & Cooper

[57] ABSTRACT

This invention relates to a electronic chorus and tremulant system for an electrical musical instrument such as an electronic piano or an electronic organ. A plurality of different sub groups of tone signals representing musical notes are separately collected from a conventional tone generating system. A bucket brigade delay line vibrato system is incorporated in each of a plurality of transmission channels each having a loudspeaker at its output. The instantaneous pitch of the signals in each channel is cyclically varied by varying the time delay introduced by its bucket brigade delay line. The instantaneous pitch in each channel is caused to be different from the instantaneous pitch of every other channel so that a multiple voice chorus effect is produced. Unlike prior systems of this general type, each transmission channel is not fed identical signal information but is fed matrixed signal information wherein different sub groups of tone signals are combined with other sub groups of tone signals in a plurality of different phase relationships, and a differently matrixed signal is fed to each transmission channel.

16 Claims, 6 Drawing Figures

ELECTRONIC CHORUS AND TREMULANT SYSTEM

RELATED APPLICATIONS

This application is a continuation in part of my application Ser. No. 406,411 filed Oct. 15, 1973, now U.S. Pat. No. 3,886,835 which was a continuation of my earlier application Ser. No. 44,276 filed June 8, 1970, now abandoned.

FIELD OF THE INVENTION

This invention relates to a system for processing the electrical signals of an electrical musical instrument to produce improved chorus and/or tremolo effects.

BACKGROUND OF THE INVENTION

It is generally accepted that most electronic musical instruments, especially keyboard instruments, produce less satisfying musical results than do the acoustic instruments they attempt to imitate. Thus the electronic organ does not produce music of the same majestic quality as the pipe organ, and most electronic pianos produce results that at best can be described as pale imitations of the real thing. One of the main differences is the relative simplicity of the electronically produced signals, and the lack of the chorus, or in the case of the piano, the multiple unison effect which is inherent in the real instruments. The real instruments almost always use a large number of separately tunable tone sources, more or less widely spaced, and the acoustic wave beats that result when several notes are played simultaneously is the basis of the satisfying chorus sound. A number of attempts have been made to overcome this lack of chorus by electrically processing signals to increase their complexity. Such systems are shown in U.S. Pat. Nos. 3,083,606 and 3,160,695 both issued to Donald L. Bonham. Other patents in the same field include U.S. Pat. No. 3,749,837 issued to James Doughty, and U.S. Pat. No. 3,833,752 issued to Tijmen van der Kooij. The Bonham U.S. Pat. No. 3,083,606 employs a plurality of vibrato units for frequency modulating signals from a musical instrument. Individual vibrato units are cyclically driven in different phase relationships so that the musical signals are instantaneously detuned by different amounts in each of the plurality of different channels. The result is a desirable chorus effect if the vibrato frequency is low (i.e., in the order of ½Hz) or a chorus vibrato if the vibrato is in the order of 4 to 7 Hz. Bonham U.S. Pat. No. 3,160,695 accomplishes a similar result by using an audio delay between two amplifiers each of which is coupled to a separate loudspeaker, with the delay accomplishing the phase shifting of the vibrato modulation. The result again is a chorus tremolo effect. The Doughty patent describes a variable digital delay line system arranged to produce vibrato effect. The digital vibrato systems of Doughty are ideally adapted to modern integrated circuit techniques. The "bucket brigade" analog, digital, variable, delay lines as described by Doughty are particularly suitable as the basic vibrato modulators required in the chorus systems of Bonham.

The van der Kooij patent describes a variation of the Bonham system using Doughty type vibrato modulators. The present invention is an improvement on systems of the general type just described.

OBJECTS OF THE INVENTION

It is an object of the invention to provide an improved chorus and/or vibrato system having more pronounced spacial characterists than those heretofore known. Another object of the invention is to produce an improved vibrato chorus system in which a tremulant identity is maintained along with an improved chorus effect. Another object of the invention is to provide a chorus generating system suitable for use with acoustic instruments such as pipe organs or orchestras. These and other objects will become apparent from the disclosure that follows:

SUMMARY OF THE INVENTION

In the present invention a plurality of vibrato units, preferrably of the bucket brigade variable delay line type, are respectively associated with a plurality of parallel transmission channels each with a loudspeaker at its output. By cyclically varying the time delay introduced by the delay lines, a Doppler vibrato is produced in each channel and a chorus, or a vibrato chorus, effect is produced by the combined effect of all of the transmission channels operating simultaneously. The acoustic wave beats that occur when certain musical tone intervals are sounded are used to enhance the chorus effect and to add increased dimension to the resulting sounds by causing the beats to appear in different phase relationships in the different transmission channels. This is accomplished by collecting two or more sub groups of signals from a conventional tone generating system with each of the sub groups designed to include only some of the tone signals generated by the tone generating system, and with the object of including in each group tone signals selected to beat strongly with tone signals of the other sub groups. For example: In a two channel system particularly suitable for tone generating systems wherein the octave relationships are locked together in a perfect mathmatical relationship it is desirable that one sub group contain all of the tone signals corresponding to the notes C, D, E, F♯, G♯, and A♯, and the other sub group contain the notes C♯, D♯, F, G, A, and B. A more desirable two channel system for musical instruments having tone generators that do not produce mathmatically perfect octaves would be an arrangement where alternate octaves appear in alternate sub groups. Generally speaking, the more sub groups and the more channels used, the better the results, and four channel systems are substantially better than two channel systems. A four channel system can be advantageously provided wherein a first channel includes the even numbered octaves of the notes C, D, E, F♯, E♯ and A♯. A second channel includes the odd numbered octaves of the same notes. A third channel includes the even numbered octaves of the notes C♯, D♯, F, G, A, and B and a fourth channel includes the odd numbered octaves of the same notes. Still other combinations of notes can be provided and it is possible to make systems with an odd number of channels as well as systems with an even number of channels. With four channels it is possible to provide results such that still more channels make only very small increments of improvement. In one embodiment of the invention all of the sub groups are applied to each of the transmission channels, but the different sub groups are combined in different phase relationships such that the wave beats produced in each loudspeaker will have their maxima and minima occur at different times. Thus the amplitude modulation that results from these wave beats will average out, leaving a minimum effect of amplitude variations but a maximum spacial illusion because of the complicated, shifting, acoustic mixing of the signals at each of the listeners' two ears.

For purposes of the following description, the term "tone generator" is employed as a generic term which may encompass either full range tone signal producing generators or sub groups of tones derived therefrom.

DESCRIPTION OF A PREFERRED EMBODIMENT

Figure 1:
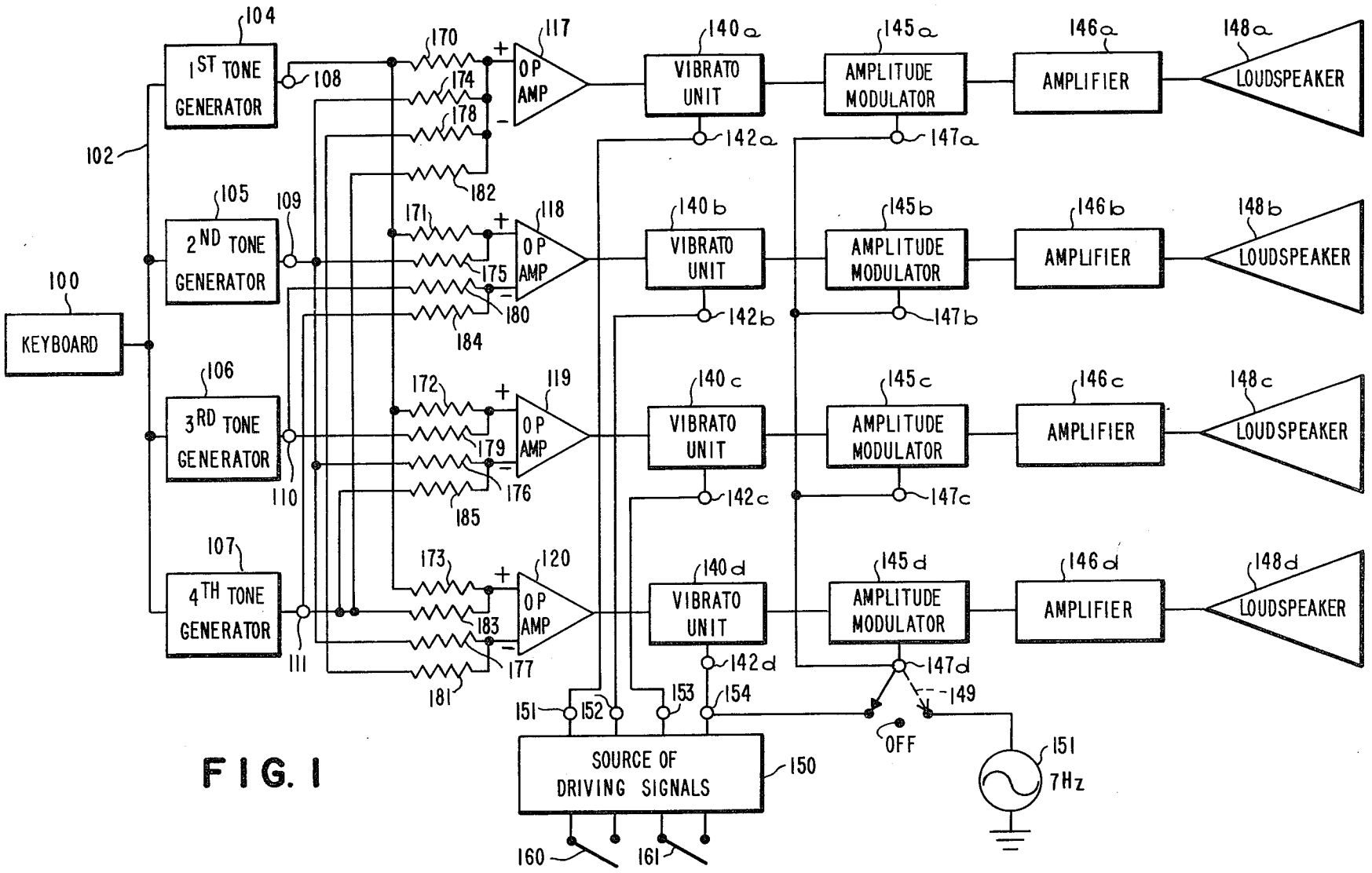
FIG. 1 is a block diagram of a chorus generating system according to the invention.

Referring first to FIG. 1, 100 is a keyboard connected by the cable 102 to the four tone generators 104, 105, 106, and 107. Each of these tone generators can be complete full range tone generators capable of generating all of the notes of a musical scale, but more commonly each of the four tone generators is adapted to produce only some of the notes of a musical scale. In this example, generator 104 produces the notes C, D, E, F♯, G♯, and A♯ in the first, third, and fifth octaves. Generator 105 produces the same notes in the second, fourth, and sixth octaves. Generator 106 produces the notes C♯, D♯, F, G, A, and B in the first, third, and fifth octaves, and generator 107 produces the same notes in the second, fourth, and sixth octaves. Each of the four generators has an output terminal, numbered respectively 108, 109, 110, and 111. It should be understood that operating the various keys (not individually shown) of the keyboard 100 causes the appearance of tone signals on the output terminals. The invention does not depend on any particular type of tone generator and accordingly a more detailed description of their operation will not be given. 117, 118, 119, and 120 are operational amplifiers having the conventional inverting and non-inverting input terminals labeled − and + respectively. The output of operational amplifier 117 is connected to the input of a vibrato unit 140*a.* A preferred type of vibrato unit will be described in greater detail in connection with FIG. 2, but it may be any type of phase or frequency modulator capable of producing vibrato rate modulation in response to a driving signal applied to its control terminal 142*a.* In this disclosure, the term vibrato is intended to encompass any sub sonic modulation, although it will usually be in the order of 0.1 to 0.8 Hz, or between about 5 Hz and 8 Hz. The lower range of values when used according to the invention produces a chorus effect and the higher range of values produces a spacial tremulant effect. The output of the vibrato unit is connected to the amplitude modulator 145*a,* which is connected to the power amplifier 146*a* whose output is connected to the loudspeaker 148*a.*

Three additional vibrato units, amplitude modulators, power amplifiers, and loudspeakers are shown and are labeled with similar reference characters except for the suffix. Each vibrato unit and power amplifier constitutes a transmission channel and each transmission channel is connected to a separate loudspeaker. An amplitude modulator 145 is shown included in each transmission channel, but is not essential to the basic operation of the system, and in practice might be included or not, or might be included in only some of the transmission channels. The components of one transmission channel have the suffix *a,* the other three transmission channels having suffixes *b, c,* and *d.*

150 is a source of driving signals for the vibrato units. When in operation, vibrato frequency driving signals appear on each of four terminals 151, 152, 153, and 154, which are respectively connected to vibrato unit control terminals 142*a,* 142*b,* 142*c,* and 142*d.* The driving signals are preferably synchronous and uniformly displaced in phase. In other words, the signals on the four terminals will be phase displaced by 90° one from another. Thus if the signal on terminal 151 is at 0°, the signals at terminals 152, 153, and 154 will have phases of 90°, 180°, and 270°, respectively. Switches 160 and 161 control the source of driving signals. When switch 160 is closed the frequency of the driving signals on terminals 151 through 154 will be in the order of 0.5 Hz. When switch 161 is closed, driving signals in the order of 6 Hz are produced. When both switches are closed, the driving signals will be the superimposed combination of the two frequencies.

The improved performance of the apparatus of the present invention results from the manner of connecting the previously described tone generators to the plurality of transmission channels. Although each tone generator is connected to each transmission channel, the phase relationships between the signals from the various generators are caused to be different in each channel. This is accomplished (in this illustrative embodiment) by connecting the various tone generators through resistors to different combinations of the inverting and non-inverting inputs of the operational amplifiers. It should again be emphasized that signals applied to an inverting (−) input will appear at the output phase displaced 180° as compared to signals applied to non-inverting input (+). Still referring to FIG. 1, tone generator 104 is connected to the + terminals of operational amplifiers 117, 118, 119, and 120 by means of resistors 170, 171, 172, and 173. Tone generator 105 is connected through resistors 174 and 175 to the + terminals of operational amplifiers 117 and 118, and through resistors 176 and 177 to the − input terminals of operational amplifiers 119 and 120. Similarly, resistors 178, 179, 180, and 181 connect tone generator 106 to the + terminals of operational amplifiers 117 and 119 and to the − terminals of operational amplifiers 118 and 120. Finally tone generator 107 is connected through resistors 182, 183, 184, and 185 to the + inputs of operational amplifiers 117 and 120, and to the − inputs of operational amplifiers 118 and 119. It will be understood that the illustrated connections are exemplary, and may be modified, as by reversing the + and − connections, without affecting the operation of the system.

Each amplitude modulator has a control terminal 147, the potential of which determines the gain or attenuation through the stage. In FIG. 1, the control terminals of the four amplitude modulators are tied together and connected by means of switch 149 to one of the terminals of the source of driving signals 150, or alternatively to a separate asynchronous driving signal such as the 7 Hz sine wave oscillator 151. It would of course be possible to connect each amplitude modulator control terminal to its corresponding vibrato unit control terminal (in the same channel), but the connections shown creates the effect closest to that of a pipe organ tremulant. A very similar effect is created if amplitude modulators are only used in one or two of the channels.

The set of resistors and the phase displacement operational amplifier that connect the tone generators to a given transmission channel thus constitutes a "matrix" or "matrixing means." Other types of matrixing means are equally suitable, of course, and could use other impedance elements such as inductors or capacitors instead of, or in addition to, the resistors shown.

It is also a matter of choice whether the required phase displacement of some of the signals is achieved before, or after, the mixing impedances. In the illustrative example, this phase displacement is achieved by means of the operational amplifiers which follow the mixing impedances. Using operational amplifiers is particularly convenient because the availability of the inverting and non-inverting input terminals simplifies the matrixing means. So called current differencing or "Norton" amplifiers such as the type L.M. 3900 as manufactured by the National Semi-Conductor Corporation are well suited for this purpose.

Figure 2:
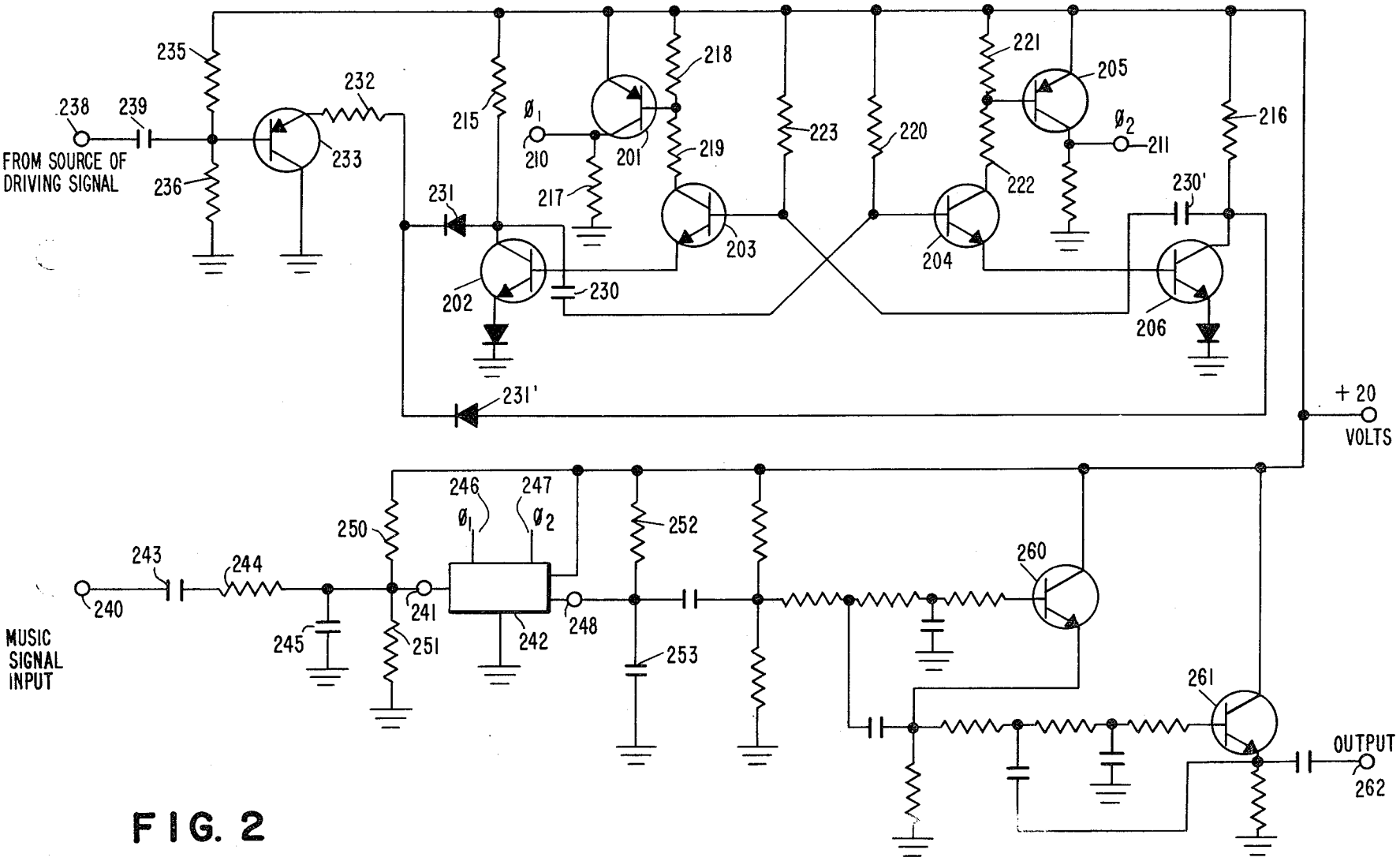
FIG. 2 is a schematic diagram of a "bucket brigade" variable delay vibrato unit suitable for use with the invention.

FIG. 2 is a schematic circuit diagram of a vibrato unit of the bucket brigade delay line type, that is suitable for use with the invention. Transistors 202, 203, 204, and 206 comprise a multi-vibrator for producing rectangular wave outputs at terminals 210 and 211, at a nominal frequency of around 100 Khz. The nominal frequency of oscillation is primarily determined by the resistors 215, 216, 220, and 223 and capacitors 230, and 230'. Transistors 201 and 205 are output switches that assure rectangular wave outputs of uniform amplitude at output terminals 210 and 211, the output signal at terminal 210 having a 180° phase relationship with respect to the output signal at 211. Diodes 231 and 231' connect through resistor 232 to the clamping transistor 233. Transistor 233 is connected in the emitter follower configuration and accordingly the voltage at the emitter will be a substantial duplicate of the voltage at the base, which is nominally set at +10 volts by the voltage divider consisting of resistors 235 and 236 which have equal ohmic values. Applying a low frequency (subsonic) driving signal to terminal 238 causes the voltage at the collectors of transistors 202 and 206 to swing above and below the half supply nominal voltage. The frequency of the multivibrator (clock) is thus varied above and below nominal frequency over a range between about 30 Khz and 300 Khz, and the variation is approximately linear with respect to the voltage applied to terminal 238. Audio signals can be applied to the input terminal 240 of the bucket brigade delay line 242 through the coupling capacitor 243 and the RC filter 244 and 245. The purpose of this filter is to eliminate harmonics from the input signal that are above the useful audio range and that would cause beats or heterodynes with the clock frequency and appear in the output as undesired spureous frequencies. The bucket brigade integrated circuit 242 may be the type TCA 350 as manufactured by ITT Semiconductors. This device samples ths signal voltage applied to the input terminal 240 at a rate corresponding to the frequency of the clock signals applied to the clocking terminals 246 and 247. The bucket brigade integrated circuit 242 has an output terminal 248. Between the input and output terminals are 185 capacitors separated from one another by analog switching circuitry, and connected in cascade. With each set of clock pulses applied to terminals 246 and 247, the charge that originates on the input terminal is passed down the line, stage by stage, toward the output terminal, so that after 185 clock pulses the charge will be delivered to the output terminal. It can be seen therefore that the integrated circuit introduces a time delay between the input and output of the device corresponding to the inverse of the clock frequency times the number of bucket brigade stages. Resistors 250, 251, and 252 apply proper voltages to the integrated circuit from the power source shown as +20 volts. Capacitor 253 integrates the output signal pulses and recreates the original wave form as applied to the input. Transistors 260 and 261 and their associated components form conventional low pass filters which remove the clock frequency component present at the output of the bucket brigade delay line. The filtered signals appear at the output terminal 262. The minimum clock frequency that can be tolerated is determined by the maximum high frequency response required of the audio channel, it being necessary that the difference between the highest desired audio frequency and the clock frequency be above the highest audio frequency of interest; otherwise heterodynes between the clock and the audio signals will be in the audio pass band and will be heard as objectionable squeals.

Figure 3:
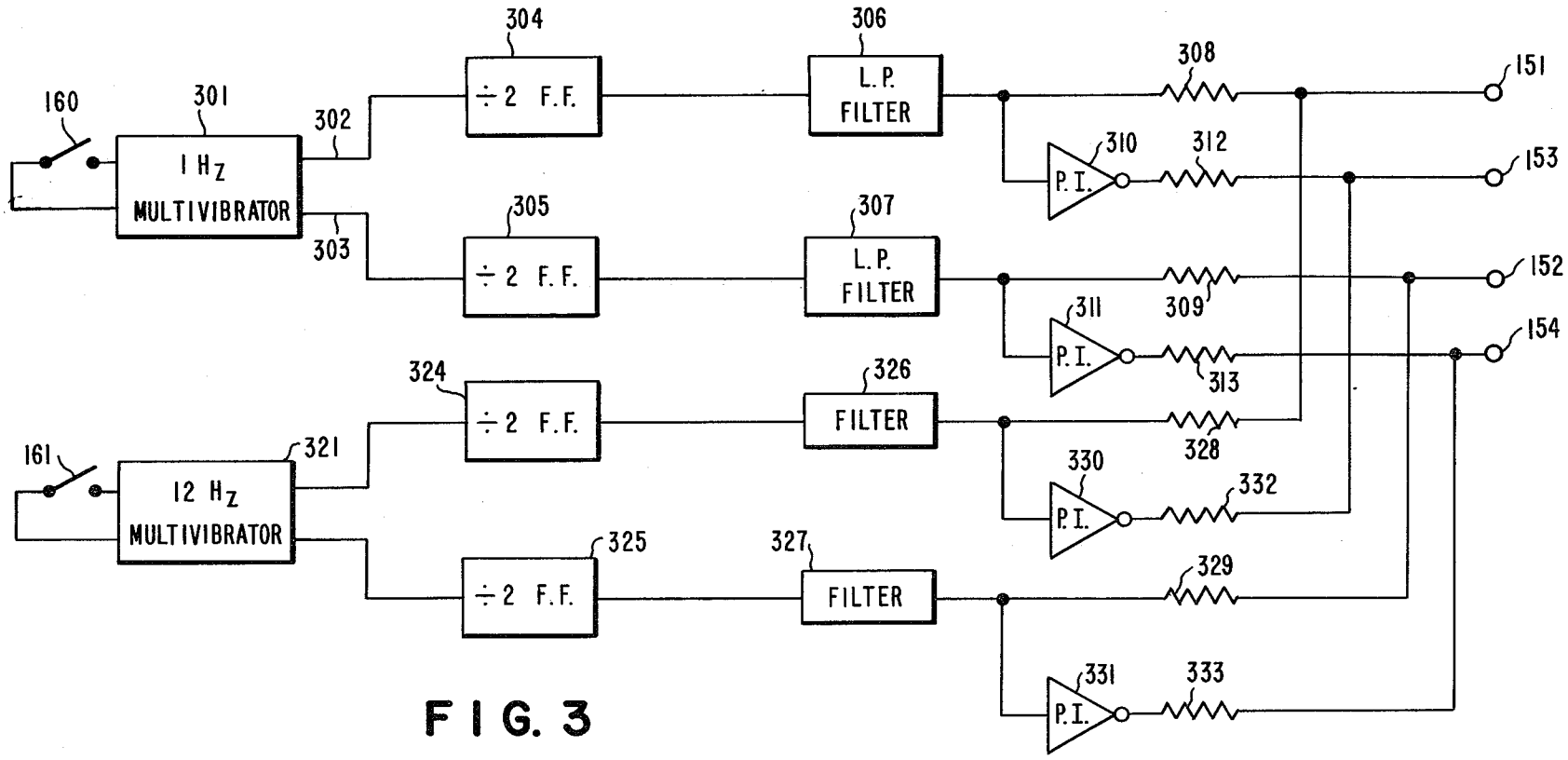
FIG. 3 is a schematic diagram of a source of driving signals for operating a plurality of vibrato units in accordance with the invention.

The chorus generating system of the invention requires the use of a plurality of vibrato units. In addition it is necessary that each of the vibrato units be connected to a source of driving signals such that the phase of the vibrato produced by one vibrato unit will be properly different than the phase of the vibrato produced by each of the other vibrato units. FIG. 3 is a block diagram of a suitable source of the multiple driving signals required.

Referring now to FIG. 3, 301 is conventional multivibrator which upon closure of the switch 160 produces rectangular wave outputs at its two terminals 302 and 303 at a frequency of about 1 Hz. When these signals are derived in the conventional manner from the collectors of the multi-vibrator transistors, the signals appearing on terminals 302 and 303 will be of the same frequency but will be 180° out of phase. 304 and 305 are divide-by-two flip-flops that divide the frequency of the multivibrator by two and with the additional result that the signals at the output of the two flip-flops will be 90° out of phase. Filters 306 and 307 are conventional low pass filters that change the square wave outputs of the flip-flops to substantially sinusoidal wave forms at the outputs of the filter. Thus at the output of each filter we have a sine wave having a frequency of 0.5 Hz and the two sine waves are phase displaced by 90°. Resistors 308 and 309 apply these signals to the output terminals 151 and 153 respectively. Each of the two filtered signals is also connected to a phase inverter 310 or 311 whose outputs are connected through resistors 312 and 313 to output terminals 152 and 154 respectively. Thus whenever switch 160 is closed, four sine waves, each having a frequency of 0.5 Hz, will appear on the respective output terminals, and the four signals will all be phase displaced by 90° one from another. These terminals are then connected to their respective vibrato units as shown in FIG. 1. Another multi-vibrator 321 operating at 12 Hz, and flip-flops 324 and 325, filters 326 and 327 and resistors 328, 332, 329, 333, and phase inverters 330 and 331 comprise a system similar to that just described for generating 6 Hz driving signals in response to the closure of switch 161. These driving signals are applied to the same output terminals 151 through 154. If both switches 160 and 161 are closed the signals at the output terminals will include both 0.5 and 6 Hz components.

Systems have been built where the lower frequency driving signal (0.5 Hz) has been derived by dividing the frequency of the higher driving signal (6 Hz) by a fixed ratio (12), and this appears to produce substantially identical results to those obtained using the two free running multi-vibrators shown.

ALTERNATE FORMS OF THE INVENTION

Figure 4:
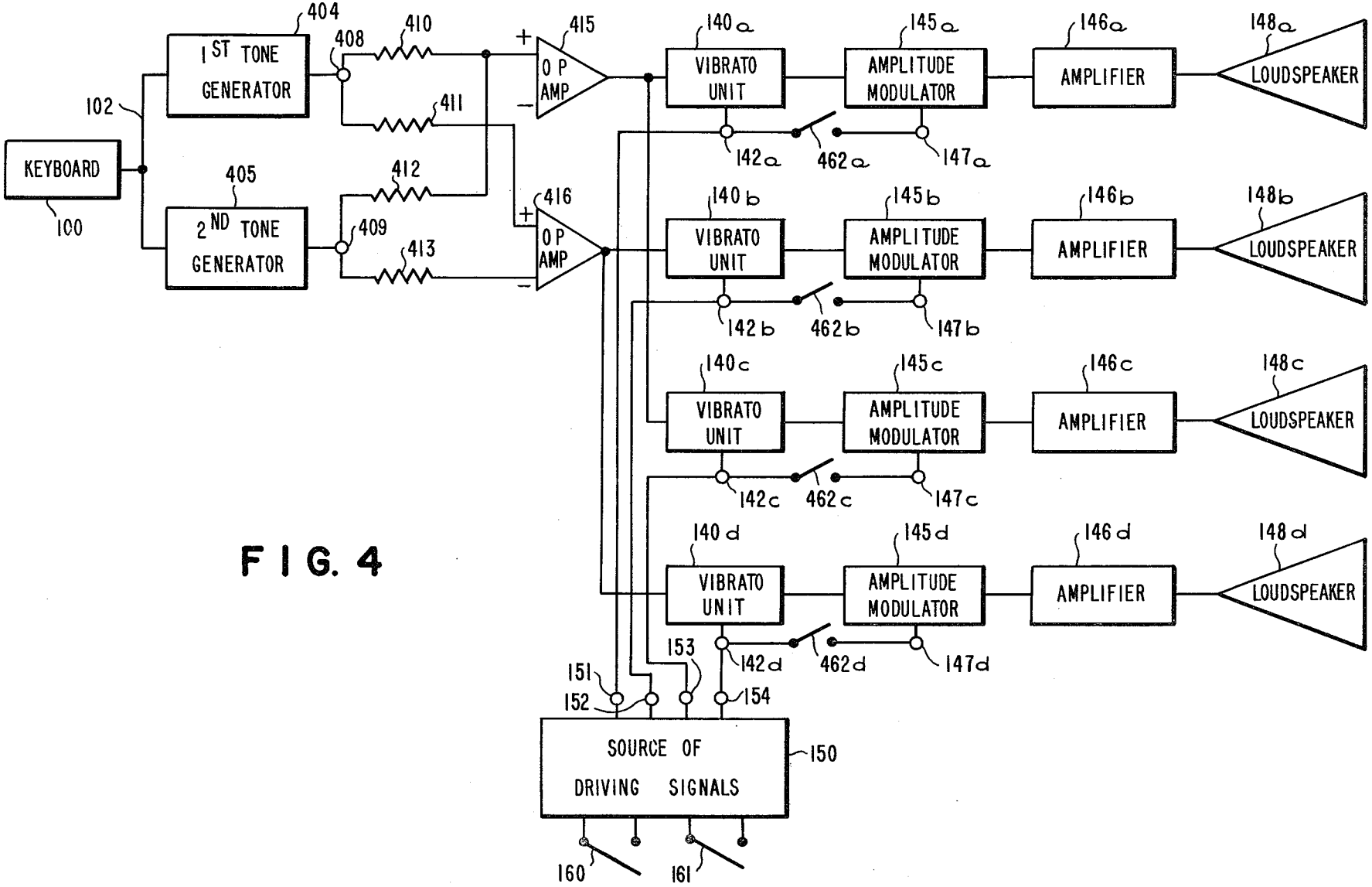
FIG. 4 is a block diagram of an alternate form of the invention.
Figures 5, 6:
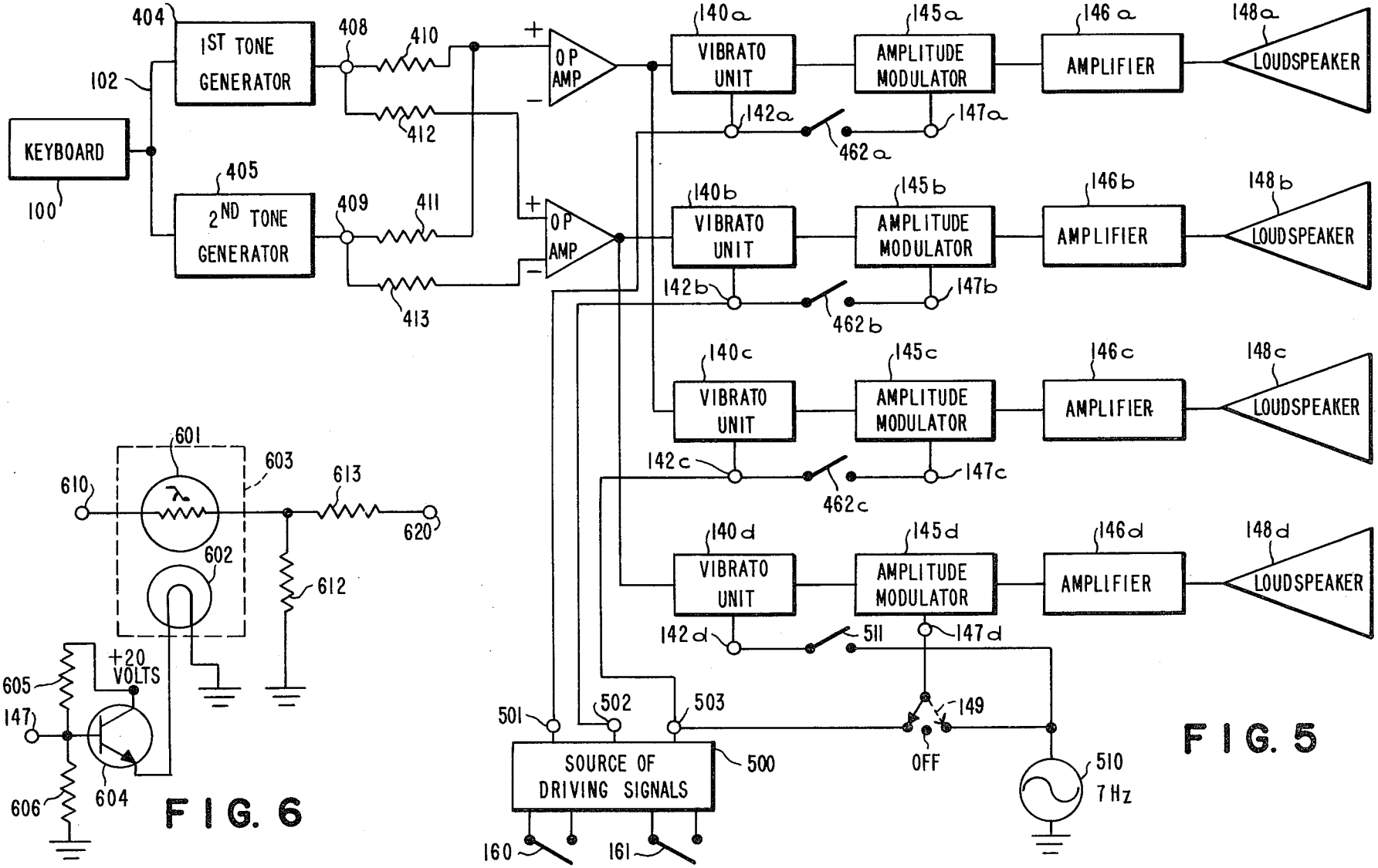
FIG. 5 is a block diagram of another alternate form of the invention.
FIG. 6 is a schematic diagram of an amplitude modulator suitable for use with the invention.

FIGS. 4, 5, and 6 show various alternate forms of the invention. In each of these figures, certain elements are labeled with reference characters the same as those used in FIG. 1 if they are functionally equivalent. Thus the operational amplifier 415, vibrato unit 140*a,* power amplifier 146*a,* comprises of a transmission channel connected to loudspeaker 148*a.* In like manner the B, C, and D channels. Referring now to FIG. 4, there are shown two tone generators connected by cable 102 to the keyboard 100. This system is particularly suitable with locked tone generating systems in which all of the octaves of a given note are perfectly in tune with one another. In this case it is desirable that the first tone generator 404 produce all of the notes C, D, E, F♯, G♯, A♯ and tone generator 405 produce the notes C♯, D♯, F, G, A, and B. The smoothness of the vibrato or chorus depends to some degree on the number of transmission channels employed, with greater smoothness resulting from an increase in the number of channels. FIG. 4 uses four transmission channels but only two tone generators. Tone generators 404 and 405 are respectively connected to the + input of the operational amplifier 415 through resistors 410 and 412. In addition tone generator 404 is connected to the + terminal of operational amplifier 416 through resistor 411 and tone generator 405 is connected to the − terminal of operational amplifier 416 through the resistor 413. The output of operational amplifier 415 is connected to the input of the vibrato units 140*a* and 140*c* and the output of operational amplifier 416 is connected to inputs of vibrato units 140*b* and 140*d.* The rest of the circuit elements are the same as shown in connection with FIG. 1 except that the amplitude modulators are each connected with a switch 462 that connects the amplitude modulator control terminal to the associated vibrato unit control terminal.

FIG. 5 is similar to FIG. 4 except that the source of driving signals 500 is adapted to produce only three phase related signals on terminals 501, 502, and 503 with the phase displacement of the three signals being 120°, as compared with the source of driving signals 150 in FIGS. 1 and 4 in which four driving signals were phase displaced by 90°. These terminals are connected respectively to the vibrato units 140*a,* 140*b,* and 140*c.* An additional oscillator 510 produces a separate, independent, driving signal for vibrato unit 140*d* whenever switch 511 is closed. This system produces a very complex vibrato chorus. With switch 511 open the signals appearing in the "D" channel will have no vibrato at all, but will acoustically mix with the signals having vibrato emanating from the speakers 148*a,* 148*b,* and 148*c.* As before, additional amplitude modulation can be added to any of the channels by means of switches 462 or 149. Many additional variations or permutations of the basic inventive concept are possible. For example any number of separate tone generators, and any number of channels, may be used, and signals can be matrixed in many different ways to the various channels. The frequency of the amplitude modulation applied to any amplifier 146 may or may not be the same as the frequency of the driving signals applied to the associated vibrato unit. While only a few combinations have been shown it should be understood that the invention is not limited to the combinations shown in the embodiments illustrated.

It is sometimes desirable to augment the sounds of a pipe organ or other acoustical instruments. It has been found that the chorus system of the invention can be used with considerable effectiveness by substituting a microphone for the more usual type of "tone generator". A microphone picking up signals from organ pipes or conventional instruments thus becomes a tone generator in the generic sense.

Synthesizer type instruments, and certain so called computer type organs, often employ a very limited number of tone generators each of which is capable of producing only one note at a time, but being instantly adjustable to produce any one of a plurality of tones as called for at the moment. The systems of this invention can be very advantageously employed with instruments of this type.

FIG. 6 shows a simple amplitude modulator suitable for use with the invention. 601 is a photo resistor of any known type whose resistance varies in response to the amount of light impinging upon its surface. Lamp 602 is positioned to shine on the photo resistor, and external light is excluded by the enclosure 603. The emitter follower transistor 604 supplies the lamp with a voltage as determined by the potential applied to the driving terminal 147. Resistors 605 and 606 bias the circuit to produce about one-half lamp brilliance when no input driving signal is applied. Signals to be modulated are applied to the input terminal 610 and appear modulated at output terminal 620. Resistor 612 has a low ohmic value compared with the resistance of the photo resistor and with resistor 613, thus causing the attenuation through the modulator to be approximately proportional to the instantaneous resistance of the photo resistor.

Others may readily adapt the invention to their specific application by employing one or more of the novel features disclosed. As at present advised I desire to claim the following subject matter:

1. A tremulant system for electrical musical instruments comprising:

a plurality of tone generators each capable of producing at least some of the notes of a musical scale;

*n* transmission channels each having an input and an output;

a plurality of loudspeakers connected respectively to the outputs of said transmission channels;

*n* vibrato units each connected between the input and output terminals of a respective one of said transmission channels;

each vibrato unit having a control terminal;

means for causing each of said vibrato units to modulate signals applied to its respective channel in response to a driving signal applied to its control terminal;

$n$ driving signals applied respectively to said control terminals;

said driving signals having phase relationships that differ by approximately $360°/n$;

first matrixing means for combining signals from each of said plurality of tone generators in one phase relationship and applying said matrixed signals to at least one of said $n$ channels;

and second matrixing means for combining signals from each of said plurality of tone generators in a different phase relationship and applying said differently matrixed signals to at least a different one of said $n$ channels.

2. A tremulant system according to claim 1 wherein $n=4$, and wherein the combined signals from the first matrixing means are applied to two of said transmission channels and the combined signals from said second matrixing means are applied to the other two of said transmission channels.

3. A tremulant system according to claim 1 with additional amplitude modulation means for imparting amplitude modulation to the signals in at least one of said transmission channels.

4. A tremulant system according to claim 1, wherein said first matrixing means comprises:

a first operational amplifier having an inverting input, a non-inverting input, and an output;

means connecting tone signals from all of said tone generators to the non-inverting input of said first operational amplifier; and means connecting said output of said first operational amplifier to at least one of said $n$ channels.

5. A tremulant system according to claim 4, wherein said second matrixing means comprises:

a second operational amplifier having an inverting input, a non-inverting input, and an output;

means connecting tone signals from each of said tone generators to selected ones of said inverting and non-inverting inputs of said second operational amplifier; and means connecting said output of said second operational amplifier to at least a different one of said $n$ channels.

6. A tremulant system according to claim 1, wherein said first matrixing means comprises a first operational amplifier having at least a non-inverting input and means connecting tone signals from each of said plurality of tone generators to said non-inverting input of said first operational amplifier, and wherein said second matrixing means comprises a plurality of operational amplifiers each having an inverting and a non-inverting input and means connecting tone signals from each of said plurality of tone generators to each of said plurality of operational amplifiers, the tone signals from each tone generator being applied to a selected one of said inverting and non-inverting inputs for each of said plurality of operational amplifiers.

7. A tremulant system according to claim 1, wherein $n=4$, wherein said first matrixing means combines said signals in a first phase relationship and applies its matrixed signals to a first one of said channels, and wherein said second matrixing means combines said signals in a second phase relationship and applies its matrixed signals to a second one of said channels, said system further including:

third matrixing means for combining signals from each of said plurality of tone generators in a third phase relationship and applying its matrixed signals to a third one of said channels; and fourth matrixing means for combining signals from each of said plurality of tone generators in a third phase relationship and applying its matrixed signals to a third one of said channels.

8. A tremulant system for electrical musical instruments, comprising:

a plurality of tone generators each capable of producing tone signals corresponding to at least some of the notes of a musical scale;

phase displacement means including a plurality of operational amplifiers each having a first input and an output, at least some of said amplifiers also having a second input, one of said inputs being an inverting input and the other being a non-inverting input;

a multiple channel chorus generating system, each channel having an input and an output, and each channel including a vibrato unit for continuously frequency modulating signals applied to the corresponding channel input;

connecting means between the output of each of said operational amplifiers and the input of at least one of said channels of said multiple channel chorus generating system; and impedance means connecting each of said plurality of tone generators to a selected one of said first and second inputs of each of said operational amplifiers so that signals simultaneously produced in at least two of said tone generators are combined in different phase relationships for application to each of said channels, with the result that the wave beats that occur due to the simultaneous sounding of tone intervals produced from at least two different tone generators are applied through said operational amplifiers to said channels.

9. A tremulant system according to claim 8, wherein said vibrato unit is a variable bucket brigade delay line, and further including means for varying the vibrato unit in at least one of said channels.

10. A tremulant system according to claim 9, wherein said means for varying said vibrato units includes means producing a driving signal for each vibrato unit, said driving signals being phase displaced from one another.

11. A tremulant system according to claim 10, the system including four tone generators, four phase displacement operational amplifiers and four channels, the output of each of said operational amplifiers being connected to the input of a corresponding one of said channels, and wherein said driving signals are uniformly phase displaced from one another.

12. A tremulant system according to claim 10, the system including at least two tone generators, at least two phase displacement operational amplifiers, and four channels, the output of each of said operational amplifiers being connected to the inputs of at least two of said channels.

13. A tremulant system according to claim 10, the system including two tone generators, two phase displacement operational amplifiers, and three channels, the output of one of said operational amplifiers being connected to the input of two of said channels and the output of the other of said operational amplifiers being connected to the input of the remaining channel, and wherein said driving signals are phase displaced by 120° from each other.

14. A tremulant system according to claim 13, further including a fourth channel having its input connected to the output of said other operational amplifier, the variable vibrato unit of said fourth channel being driven independently of said driving signals whereby the sound produced by said three channels has a multiple voice vibrato chorus effect and the sound produced by said fourth channel compensates for interval beats produced by said three channels.

15. A tremulant system according to claim 10, wherein each channel further includes an amplitude modulator, said system further including means for selectively driving said amplitude modulator.

16. A tremulant system for electrical musical instruments comprising:

a plurality of tone generators each capable of producing at least some of the notes of a musical scale;

*n* transmission channels each having an input and an output;

a plurality of loudspeakers connected respectively to the outputs of said transmission channels;

*n* vibrato units each connected between the input and output terminals of a respective one of said transmission channels;

each vibrato unit having a control terminal;

means for causing each of said vibrator units to modulate signals applied to its respective channel in response to a driving signal applied to its control terminal;

*n* driving signals each of which is applied to a respective one of said control terminals, said driving signals having phase relationships that differ by approximately 360°/*n;* first matrixing means including a phase inverting input, a non-inverting input, and an output;

means connecting the signals from each of said plurality of tone generators to one or the other of the inputs of said first matrixing means to combine said signals in one phase relationship;

means connecting the combined signals appearing at said output of said first matrixing means to the input of at least one of said *n* channels;

second matrixing means including a phase inverting input, a non-inverting input, and an output;

means connecting the signals from each of said plurality of tone generators to one or the other of the inputs of said second matrixing means to combine said signals in a different phase relationship; and means connecting the combined signals appearing at said output of said second matrixing means to the input of at least a different one of said *n* channels.

* * * * *